US011571027B2

(12) United States Patent
Raymond

(10) Patent No.: US 11,571,027 B2
(45) Date of Patent: Feb. 7, 2023

(54) ACTIVE-WEAR BRA AND METHOD

(71) Applicant: Ruby Ribbon, Inc., Burlingame, CA (US)

(72) Inventor: Camilla Raymond, San Francisco, CA (US)

(73) Assignee: Ruby Ribbon, Inc., Burlingame, CA (US)

( * ) Notice: Subject to any disclaimer, the term of this patent is extended or adjusted under 35 U.S.C. 154(b) by 122 days.

(21) Appl. No.: 17/306,588

(22) Filed: May 3, 2021

(65) Prior Publication Data

US 2021/0251307 A1 Aug. 19, 2021

Related U.S. Application Data

(63) Continuation of application No. 16/516,012, filed on Jul. 18, 2019, now Pat. No. 10,993,482.

(51) Int. Cl.
*A41C 3/00* (2006.01)

(52) U.S. Cl.
CPC ..... *A41C 3/0057* (2013.01); *A41C 3/0092* (2013.01)

(58) Field of Classification Search
CPC ..... A41C 3/0057
USPC ..... 450/39
See application file for complete search history.

(56) References Cited

U.S. PATENT DOCUMENTS

| | | | | |
|---|---|---|---|---|
| 6,837,771 | B2 * | 1/2005 | Falla | A41C 3/0014 2/400 |
| 7,131,888 | B2 * | 11/2006 | Hsu | A41C 3/0007 450/39 |
| 8,113,908 | B1 * | 2/2012 | Modena | A41C 5/00 450/39 |
| 10,993,482 | B2 * | 5/2021 | Raymond | A41C 3/0057 |
| 2003/0092355 | A1 * | 5/2003 | Rabinowicz | A41C 5/00 450/1 |
| 2006/0223415 | A1 * | 10/2006 | Watrin | A41C 3/0014 450/39 |
| 2009/0098803 | A1 * | 4/2009 | Reinisch | A41C 3/0014 450/86 |
| 2012/0122370 | A1 * | 5/2012 | Heath | A41C 3/0057 450/80 |
| 2013/0225045 | A1 * | 8/2013 | Dandapure | A41C 5/005 450/39 |
| 2016/0044971 | A1 * | 2/2016 | Randall | A41C 3/142 450/39 |
| 2017/0340023 | A1 * | 11/2017 | McKeen | A41D 27/24 |
| 2018/0242653 | A1 * | 8/2018 | Brandt | B32B 5/24 |
| 2018/0279692 | A1 * | 10/2018 | Witek | A41C 3/0057 |

* cited by examiner

*Primary Examiner* — Gloria M Hale
(74) *Attorney, Agent, or Firm* — Moser Taboada

(57) ABSTRACT

An athletic bra to support a human wearer's breasts include a band, a breast covering section, a back section, and a pair of shoulder straps joining the breast covering section to the back section. The breast covering section includes an inner layer forming a pair of molded cups, each cup constructed to encapsulate a respective one of the breasts. A support member is bonded to the inner layer and includes a lower section extending between each of the cups and the band, and a medial section extending at least partially between the cups. The bra can accommodate band sizes of 32-50 and cup sizes of AAA-K.

19 Claims, 5 Drawing Sheets

ACTIVE-WEAR BRA AND METHOD

CROSS-REFERENCE TO RELATED APPLICATIONS

This application is a continuation of co-pending U.S. patent application Ser. No. 16/516,012 entitled "ACTIVE-WEAR BRA AND METHOD" and filed Jul. 18, 2019, which is herein incorporated in its entirety by reference.

TECHNICAL FIELD

This disclosure relates to active-wear garments. In particular, this disclosure relates to an athletic bra utilized to support and stabilize breasts during physical exercise or activities.

BACKGROUND

Exercise and physical fitness are important for health and wellness. Women and large breasted male athletes have a need for a garment that will support, stabilize, and prevent excessive movement of the breasts during physical exercise or activities.

Many active-wear have band sizes that are no larger than a 38 and cup sizes of no larger than DDD. Since athletes and women who are involved in physical fitness come in a variety of sizes, including those with band sizes greater than 38 and cup sizes of greater than DDD, there is a need for an active-wear bra that can accommodate such sizes. In addition, having an active-wear bra that is free of wires and zippers is also an important part of ensuring comfort.

In addition, many prior art athletic bras result in a "uniboob" appearance. That is, many prior art athletic bras do nothing but compress the breasts and do not show individual breast definition. Instead, the resulting appearance is of one single hump across the width of the chest. Many women find this objectionable, and desire to have each breast defined. Therefore, there is also a need to end the "uniboob" appearance and, instead, show individual breast definition.

Over the past twenty years, the average bra size in the United States has increased from 34B to 34DD. According the NIH, 80% of adults are overweight and 67% of adult women are size 14 or higher. Activity is an important part of a healthy life style; yet, active-wear designed to support all breasts and specifically larger ones is not available for the larger woman who most needs it.

Improvements in athletic bras are desirable for at least all of these reasons.

SUMMARY

An athletic bra is provided that improves the prior art.

In accord with general principles, an athletic bra is provided to support a human wearer's breasts. The bra includes a band to surround the wearer's torso and a breast-covering section secured to the band. A back section is secured to the band, while a pair of shoulder straps join the breast covering section and the back section. The breast-covering section includes an inner layer of fabric including a pair of cups molded into the fabric, and a support member. Each cup is molded into the fabric and constructed and arranged to encapsulate a respective one of the breasts. The support member is bonded to the inner layer. The support member includes a lower section extending between each of the cups and the band, and a medial section extending at least partially between the cups.

The breast covering section can further include an outer layer covering the inner layer.

The support member can further include a first lateral section and a second lateral section. The first lateral section extends from the lower section at least partially along a side of a first one of the cups, so that the first one of the cups is positioned between the first lateral section and the medial section. The second lateral section extends from the lower section at least partially along a side of the second one of the cups, so that the second one of the cups is positioned between the second lateral section and the medial section.

In many embodiments, the lower section, the medial section, first lateral section, and second lateral section are contiguous.

In many embodiments, the lower section, medial section, first lateral section, and second lateral section are a same continuous piece of material.

In many examples, the medial section extends from the lower section between the cups no more than 75% of a diameter of the cups.

In example embodiments, the medial section extends from the lower section between the cups to no more than 50% of a diameter of the cups.

The first lateral section and the second lateral section may each extend from the lower section a distance of greater than 50% of a diameter of the cups.

The first lateral section and the second lateral section may each extend from the lower section a distance of greater than 75% of a diameter of the cups and less than 95% of the diameter of the cups.

In example embodiments, the medial section is convex-curve shaped.

The back section can include an outer layer secured to the band and extending to the shoulder straps, and an inner layer bonded to the outer layer and spaced from the band. The inner layer is bonded to the outer layer along two intersecting bond strips, with each strip extending diagonally across the back section.

In example embodiments, the inner layer comprises a fabric that is at least 80% nylon and no greater than 20% spandex.

In many example implementations, the inner layer comprises a fabric that is 87% nylon and 13% spandex and having a weight of 7 ounces per square yard.

Example embodiments further include a first side panel secured to the band and extending between a first side of the breast covering section and the back section, and a second side panel secured to the band and extending between a second side of the breast covering section and the back section. Arm holes are defined by free edges of the breast covering section, back section, first side panel, and second side panel.

Example embodiments include the band having a circumference of even numbers between 32 inches and 50 inches, inclusive.

Example embodiments include the cups of the inner layer being able to accommodate any cup size, ranging from AAA up to and including K.

In another aspect, an inner support construction used with an athletic bra to support a human wearer's breasts is provided. The inner support construction includes a layer of fabric having a pair of cups molded from the fabric; each cup being constructed and arranged to encapsulate a respective one of the breasts; the layer having a bottom edge for attachment to a band and an opposite edge; the cups being spaced between the edges; and a support member bonded to the layer. The support member has (i) a lower section extending between each of the cups and the bottom edge; (ii) a medial section extending at least partially between the cups; (iii) a first lateral section extending from the lower section at least partially along a side of a first one of the cups, so that the first one of the cups is positioned between the first lateral section and the medial section; and (iv) a second lateral section extending from the lower section at least partially along a side of a second one of the cups, so that the second one of the cups is positioned between the second lateral section and the medial section.

In example embodiments, the lower section, medial section, first lateral section, and second lateral section are a same continuous piece of material; the medial section extends from the lower section between the cups no more than 75% of a diameter of the cups; the first lateral section and the second lateral section each extends from the lower section a distance of greater than 50% of a diameter of the cups; the medial section is convex-curve shaped; and the layer comprises a fabric that is at least 80% nylon and no greater than 20% spandex.

In another aspect, a method of making an athletic bra is provided. The method includes providing a band to surround a wearer's torso; providing a breast covering section having an inner layer forming a pair of cups, each cup constructed and arranged to encapsulate a respective one of the breasts; spraying an adhesive on a support member and bonding the support member to the inner layer. The support member has a lower section extending between each of the cups and the band and a medial section extending at least partially between the cups. The method further includes securing the breast covering section to the band; securing a back section to the band; and joining the breast covering section and back section with a pair of shoulder straps.

The method includes providing the inner layer having the pair of cups, in which the cups are made by molding the inner layer against heated molds shaped as breast cups.

The method can further include providing the support member, in which the support member includes a first lateral section and a second lateral section. The first lateral section extends from the lower section at least partially along a side of a first one of the cups, so that the first one of the cups is positioned between the first lateral section and the medial section. The second lateral section extends from the lower section at least partially along a side of a second one the cups, so that the second one of the cups is positioned between the second lateral section and the medial section.

The method further includes providing the support member, so that the medial section is convex-curve shaped.

The method can further include providing the band so that it has a circumference of even numbers between 32 inches and 50 inches, inclusive.

The method can includes providing the inner layer with the pair of cups, such that the cups can accommodate breast sizes ranging from AAA up to and including K.

A variety of desirable product features or method are set forth in the description that follows, and in part, will be apparent from the description, or may be learned by practicing various aspects of this disclosure. The aspects of this disclosure may relate to individual features, as well as combinations of features. It is to be understood that both the foregoing general description and the following detailed description are explanatory only, and are not restrictive of the claimed inventions.

DETAILED DESCRIPTION

Figure 1:
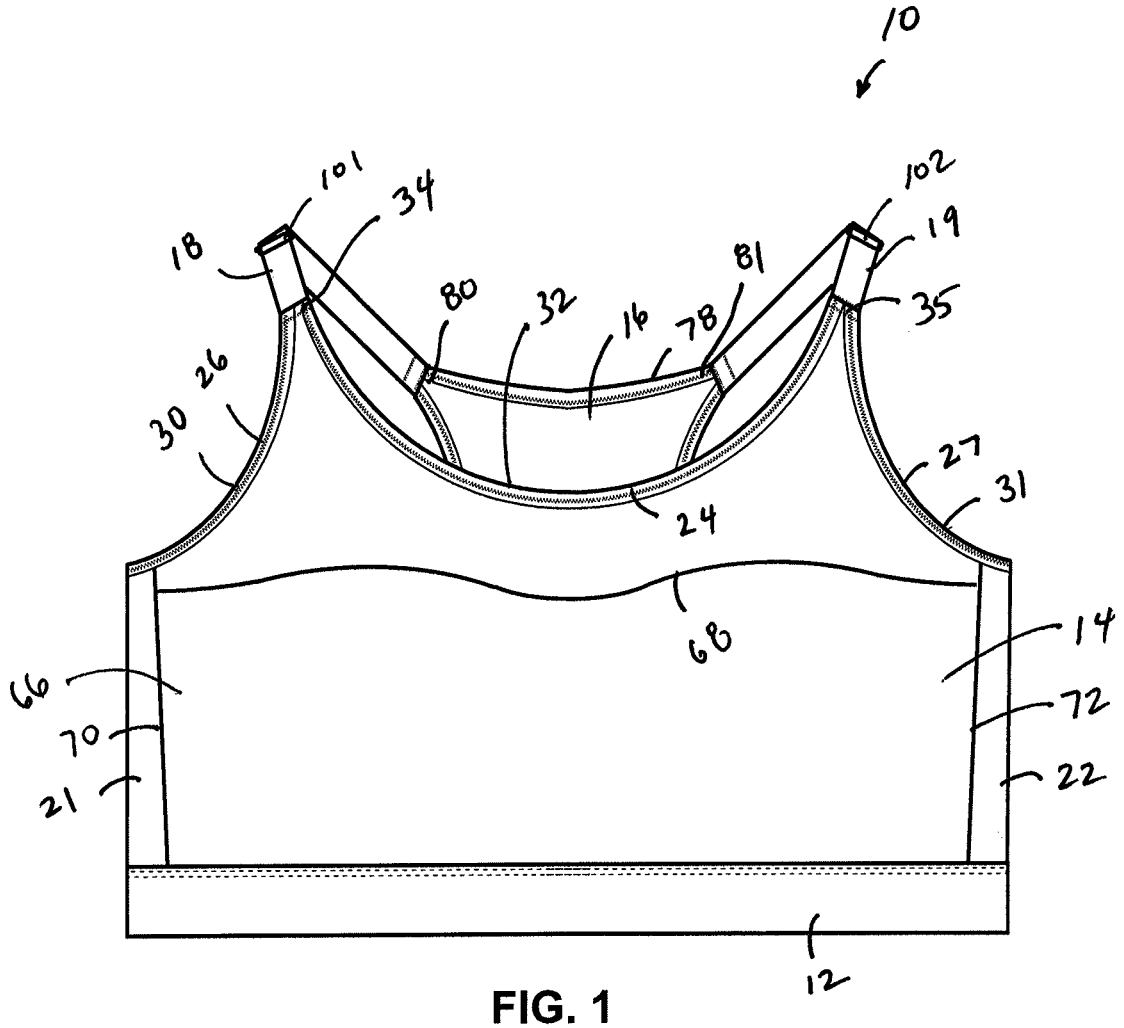
FIG. 1 is a front elevational view of an embodiment of an athletic bra, constructed in accordance with principles of this disclosure.

FIGS. 1-5 show an active-wear, or athletic bra generally at 10. The bra 10 will support the two breasts of a human who is wearing the bra 10. In general, the bra 10 supports the breasts, reduces motion of the breasts relative to the rest of the body, and results in an esthetically pleasing appearance with each breast being individually defined.

The athletic bra 10 generally includes a band 12, a breast covering section 14, a back section 16, should straps 18, 19, and first and second side panels 21, 22. A free edge 32 of the breast covering section 14 defines a neckline 24. Free edges of the breast covering section 14, back section 16, first side panel 21, and second side panel 22 result in first and second arm holes 26, 27.

In general, a person wearing the bra 10 will have the band 12 fitted around and against her torso, and each arm extending through one of the arm holes 26, 27. The shoulder straps 18, 19 will extend over a respective one of the wearer's shoulders, and the neckline 24 will be below the wearer's neck, so that the breast covering section 14 is covering and against the wearer's breasts.

The band 12 is provided to surround the torso of the person wearing the bra 10. The band 12 is typically sized so that it fits snugly around and against the torso, along the region of the torso underneath the breasts and above the navel. The band 12 can be made from a variety of materials, and preferably is an elastic band having a width of about 1 inch. The band 12 is sized to have a circumference of even numbers of at least 32 inches and typically no greater than 50 inches.

The breast covering section 14 is secured to the band 12. The breast covering section 14 extends between the first and second side panels 21, 22. A free edge 30 of the breast covering section 14 defines a portion of the first arm hole 26, while the free edge 31 of the breast covering section 14 defines a portion of the second arm hole 27. Free edge 32 of the breast covering section 14 defines the neckline 24.

The first shoulder strap 18 is attached to the breast covering section 14 at a first attachment section 34. The first attachment section 34 is between the free edge 30 and free edge 32. Similarly, the second shoulder strap 19 is secured to the breast covering section 14 at a second attachment section 35, which is located between the free edge 31 and free edge 32. The free edges 30, 31, 32 are along the breast covering section 14 that is opposite from the band 12.

Figure 2:
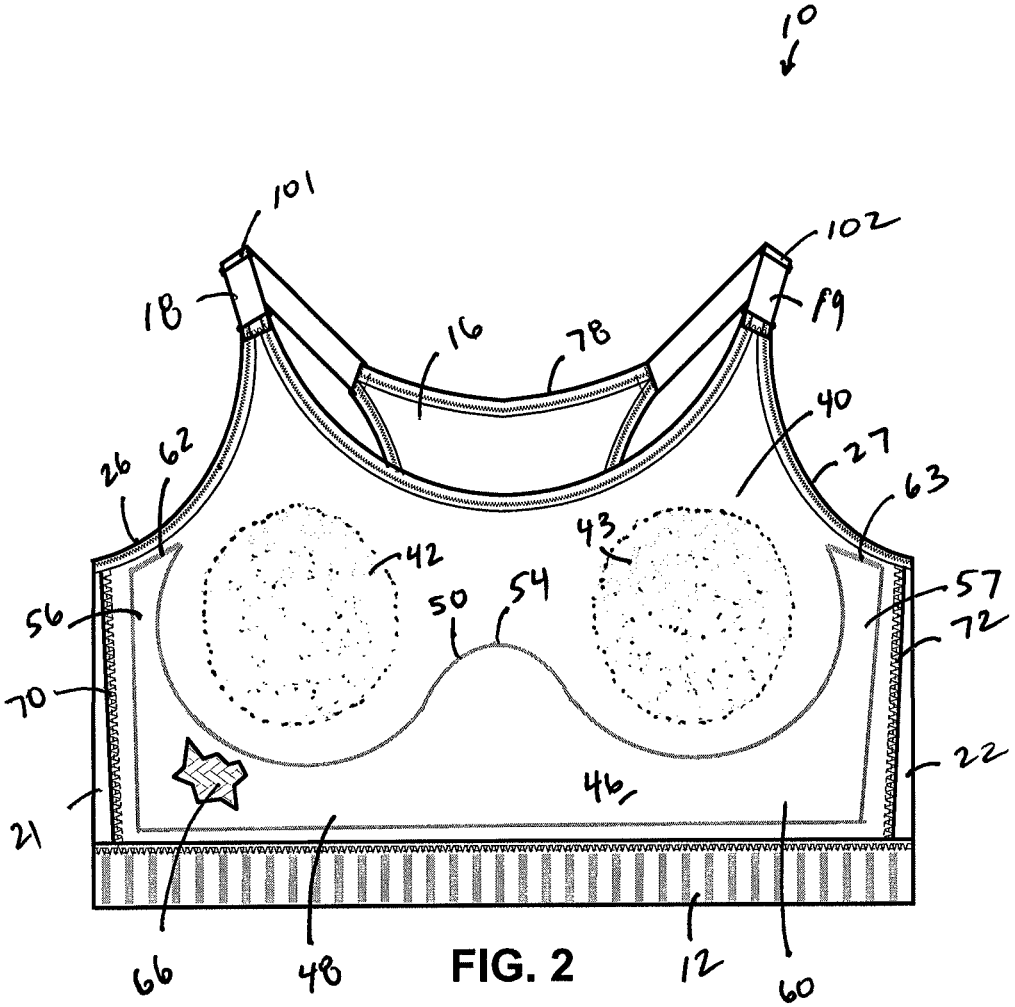
FIG. 2 is a front elevational view of the athletic bra of FIG. 1, with the outer layer removed to reveal an inner layer and a support member.
Figure 3:
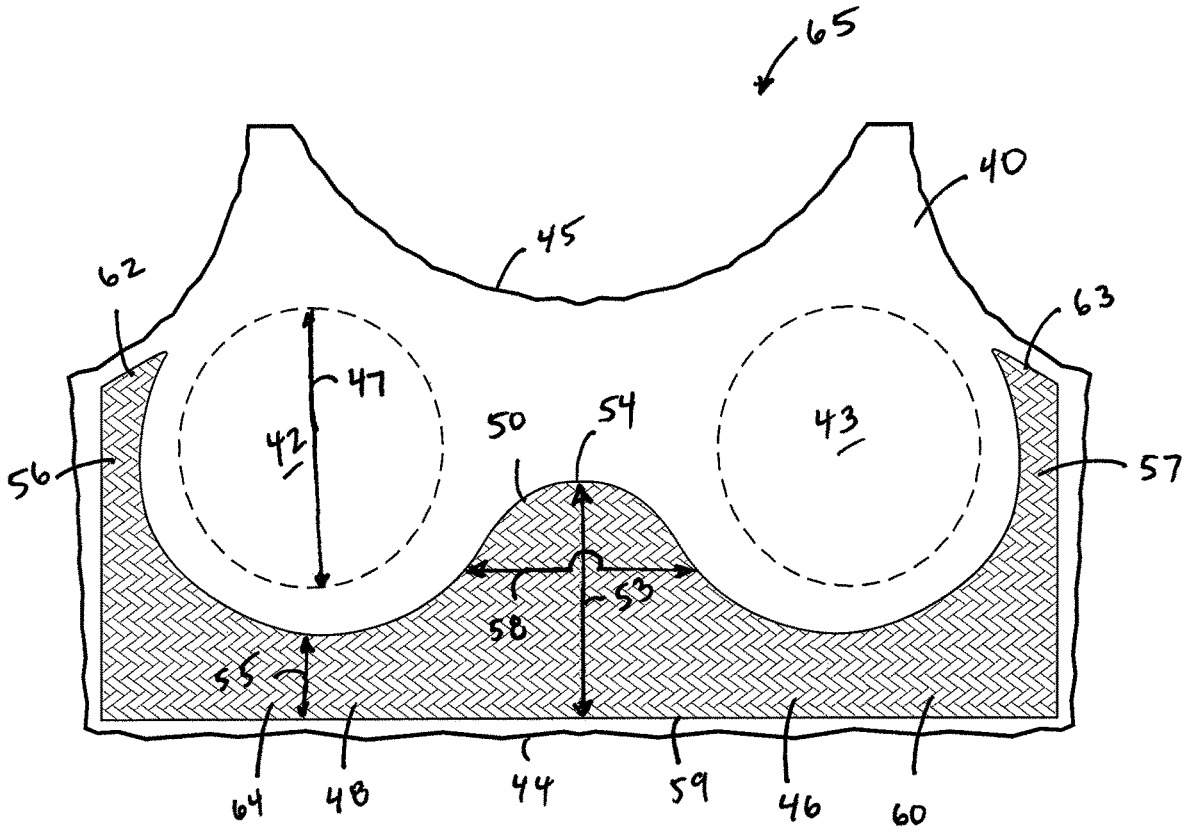
FIG. 3 is a front elevational view of an inner construction including the inner layer and support member, depicted in FIG. 2.

In accordance with principles of this disclosure, the breast covering section 14 includes an inner layer 40 (FIG. 2). While many embodiments are possible, in the one shown, the inner layer 40 is the layer of the bra 10 that is against the skin of the wearer. The inner layer 40 is a flexible fabric and forms a pair of cups 42, 43 spaced between a bottom edge 44 (FIG. 3) and an opposite upper edge 45 (FIG. 3). Each cup 42, 43 is constructed and arranged to encapsulate a respective one of the breasts of the person wearing the bra 10. The cups 42, 43 can accommodate any breast cup size, including AAA through greater than DDD and up to and including K, such as F, G, H, I, J, and K. By the term "cup size," reference is made to standard United States bra sizing, in which the cup size is determined by the following: (1) determining band size by measuring the circumference of the torso directly under the bust, in which the circumference is measured in inches and rounded to the nearest even number; and (2) determining the cup size by measuring the fullest part of the bust line, and subtracting the band measurement from the bust measurement. The difference in these measurements provides the following cup sizes:

| Bust Measurement Minus Band Size | Cup Size |
|---|---|
| Less than 1 inch | AAA or AA |
| 1 inch | A |
| 2 inches | B |
| 3 inches | C |
| 4 inches | D |
| 5 inches | DD |
| 6 inches | DDD and F |
| 7 inches | G |
| 8 inches | H |
| 9 inches | I |
| 10 inches | J |
| 11 inches | K |

The inner layer 40 can accommodate any cup size at least because of the fabric used. The fabric for the inner layer 40 is a fabric of at least 80% nylon and no greater than 20% spandex. For example, the fabric for the inner liner 40 can be 87% nylon having a yarn size of 70/34 dull nylon; and 13% spandex, in which the yarn is 40 denier; and having a weight of 7 ounces per square yard. As can be seen in FIGS. 2 and 3, the inner layer 40 has the cups 42, 43 molded into the fabric. In one non-limiting example, the cups 42, 43 are made by providing heated molds in the shape of breast cups and placing the fabric of the inner layer 40 against the molds to provide the resulting cups 42, 43. The molds used for making the cups 42, 43 are graded or scaled for each size of band 12 from size 32 through size 50. As such, in preferred implementations, each cup 42, 43 is molded into the fabric of the inner liner 40.

The fabric used for the inner layer 40 will allow the same bra 10 with a common band size to be appropriately sized, regardless of the cup sizes of the wearer. For example, a woman having a bra size of 34B can wear the same identical bra 10 as a woman who has a bra size of 34G and have the cups 42, 43 encapsulate and support her breasts.

Still in reference to FIGS. 2 and 3, the breast covering section 14 further includes a support member 46. The support member 46 is bonded to the inner layer 40. The support member 46 is wire-free and includes at least a lower section 48 extending between each of the cups 42, 43 and the band 12. As can be seen in FIGS. 2 and 3, the lower section 48 preferably extends across the width of the breast covering section 14 between the first side panel 21 and second side panel 22. The lower section 48 can be either against the upper part of the band 12 or spaced from the upper part of the band 12.

The support member 46 further includes a medial section 50. The medial section 50 extends at least partially between cup 42 and cup 43. The medial section 50 contributes to supporting and stabilizing each of the breasts, and also helping provide individual definition for each breast.

The medial section 50 extends from the lower section 48 between the cups 42, 43 a distance less than a full diameter of the cups 42, 43. In many instances, the medial section 50 extends a distance from the lower section 48 no more than 75% of a diameter 47 (FIG. 3) of the cups 42, 43. In many instances, the medial section 50 extends a distance no more than 50% of a diameter of the cups 42, 43. The medial section 50 will typically extend from the lower section 48 a distance at least 25% of a diameter of the cups 42, 43. The diameter 47 of the cups 42, 43 is the measurement of a largest distance across the cups 42, 43 along a plane that contains a remainder of the inner layer 40.

As can be seen in FIG. 3, the medial section 50 has a shape of a convex curve 52. The convex curve 52 forms a smooth hump 54, in which the peak of the hump 54, in the example embodiment shown, extends no higher than a midpoint of the cups 42, 43. While many different variations are possible, in one non-limiting example, a total height 53 of the hump 54 from a lower edge 59 of the support member 46 is at least twice, and in the FIG. 3 example, 3 times a height 55 of the lower section 48 from the lower edge, in a part of the lower section directly below the cups 42, 43. An example width of the hump 54 across a width between inflection points in the curve forming the hump 54 is about a same dimension as the height 53, and can be in a range of at least 50% to 110% of the height 53. Many variations are possible, and these are just examples.

The support member 46 further includes a first lateral section 56 and a second lateral section 57. The first lateral section 56 extends from the lower section 48 at least partially along a side of a first one of the cups 42, so that the cup 42 is positioned between the first lateral section 56 and the medial section 50. The second lateral section 57 extends from the lower section 48 at least partially along a side of the second one of the cups 43, so that the second one of the cups 43 is positioned between the second lateral section 57 and the medial section 50. The first lateral section 56 and the second lateral section 57 help to support and stabilize the breasts, in combination with the other features of the inner layer 40.

The first lateral section 56 and second lateral section 57 each extends from the lower section 48 a distance of greater than 50% of a diameter 47 of the cups 42, 43. In many instances, the first lateral section 56 and second lateral section 57 each extends from the lower section 48 a distance of greater than 75% of a diameter of the cups 42, 43 and less than 95% of the diameter of the cups 42, 43.

As can be appreciated from reviewing FIGS. 2 and 3, the lower section 48, medial section 50, first lateral section 56, and second lateral section 57 are contiguous with each other. In preferred implementations, the lower section 48, medial section 50, first lateral section 56, and second lateral section 57 are a same continuous piece of material 60. This material 60 is secured to the inner layer 40 through a bond, such as an adhesive bond. In one example method, a polyurethane adhesive is sprayed evenly on one side of the material 60 and pressed against the inner layer 40 in the pattern as shown in FIG. 3. That is, the strip of material 60 forming the support member 46 is adhesively bonded to the inner layer 40 and then allowed to cure at room temperature. During this process, the polyurethane adhesive can be warmed to the same ambient temperature as the fabric of the inner layer 40 and the strip of material 60 of the support member 46.

In many arrangements, the strip of material 46 of the support member 46 can be made from a flexible fabric, including, in many situations, the same fabric that is used for the inner layer 40. For example, the support member 46 can be made from a fabric that is at least 80% nylon, and no more than 20% spandex; with a preferred fabric being 87% nylon (yarn size of 70/34 dull nylon) and 13% spandex (yarn being 40 denier) having a weight of 7 ounces per square yard.

As can be seen in FIG. 3, the first and second lateral sections 56, 57 have free ends 62, 63 that are adjacent to the arm holes 26, 27. The free ends 62, 63 extend a distance farther from the lower section 48 than the peak of the hump 54. Between the hump 54 and the lateral sections 56, 57, the lower section 48 extends in a band 64 below the cups 42, 43 and above the main band 12.

The combination of the inner layer 40 and the support member 46 form an inner support construction 65 (FIG. 3) and results in advantages. The inner support construction 65 comprising the inner layer 40 and support member 46 allows the same bra 10 with a common band size to result in the same level of support and individual breast definition (avoiding the "uniboob" appearance), regardless of cup size. For example, a woman having a bra size of 36B can wear the same identical bra 10, have the same level of breast support, and have the same individual breast definition as a woman with the same band size (in this case, 36 inches) but different cup size such as DDD. In fact, the woman with the 36DDD size can wear the selected bra 10 and then give that same selected bra to the woman with the 36B size, and that same selected bra 10 will provide the same level of support for both women due to the inner layer 40 and the support member 46. The inner layer 40 will not be stretched out by the woman with the DDD cup size.

The breast covering section 14 further includes an outer layer 66. The outer layer 66 is broken away in FIG. 2 to reveal the inner layer 40 and support member 46. The outer layer 66 covers completely the inner layer 40 and support member 46 as it extends completely between the first side panel 21 and second side panel 22 and from the band 12 to the neckline 24. Preferably, the outer layer 66 is free of attachment to the inner layer 40 and support member 46, except along any common stitching areas along the band 12, side panels 21, 22, and free edges 30, 31, 32. The outer layer 66 is shown in FIG. 1 as having a decorative stitching line 68 extending across an upper portion of the breast covering section 14 between side panel 21 and side panel 22. In many arrangements, the decorative stitching line 68 will be above the breast cups 42, 43, and spaced below the neckline 24.

The outer layer 66 is preferably made from a flexible fabric and can be conveniently made from the same fabric of the inner layer 40 and support member 46. For example, the outer layer 66 can be made from a fabric of at least 80% nylon, no greater than 20% spandex. For example, the outer layer 66 can be a fabric that is 87% nylon (yarn size of 70-35 dull nylon) and 13% spandex (yarn being 40 denier) and a weight of 7 ounces per square yard.

The first and second side panels 21, 22 are secured to the band 12 and extend between the breast covering section 14 and the back section 16. The first and second side panels 21, 22 can be made from the same material as the outer layer 66. By reviewing FIGS. 1 and 4, it can be seen how each of the side panels 21, 22 is secured between the breast covering section 14 and back section 16. While many embodiments are possible, in the one shown, the first side panel 21 is secured to the breast covering section 14 along a line of stitching 70 extending between the first arm hole 26 and the band 12. The first side panel 21 is secured to the back section 16 along a stich line 71 extending between the arm hole 26 and the band 12.

Similarly, the second side panel 22 is secured to the breast covering section 14 along a stich line 72 extending between the arm hole 27 and the band 12. The second side panel 22 is secured to the back section 16 along a stich line 73 between the arm hole 27 and the band 12.

Figure 4:
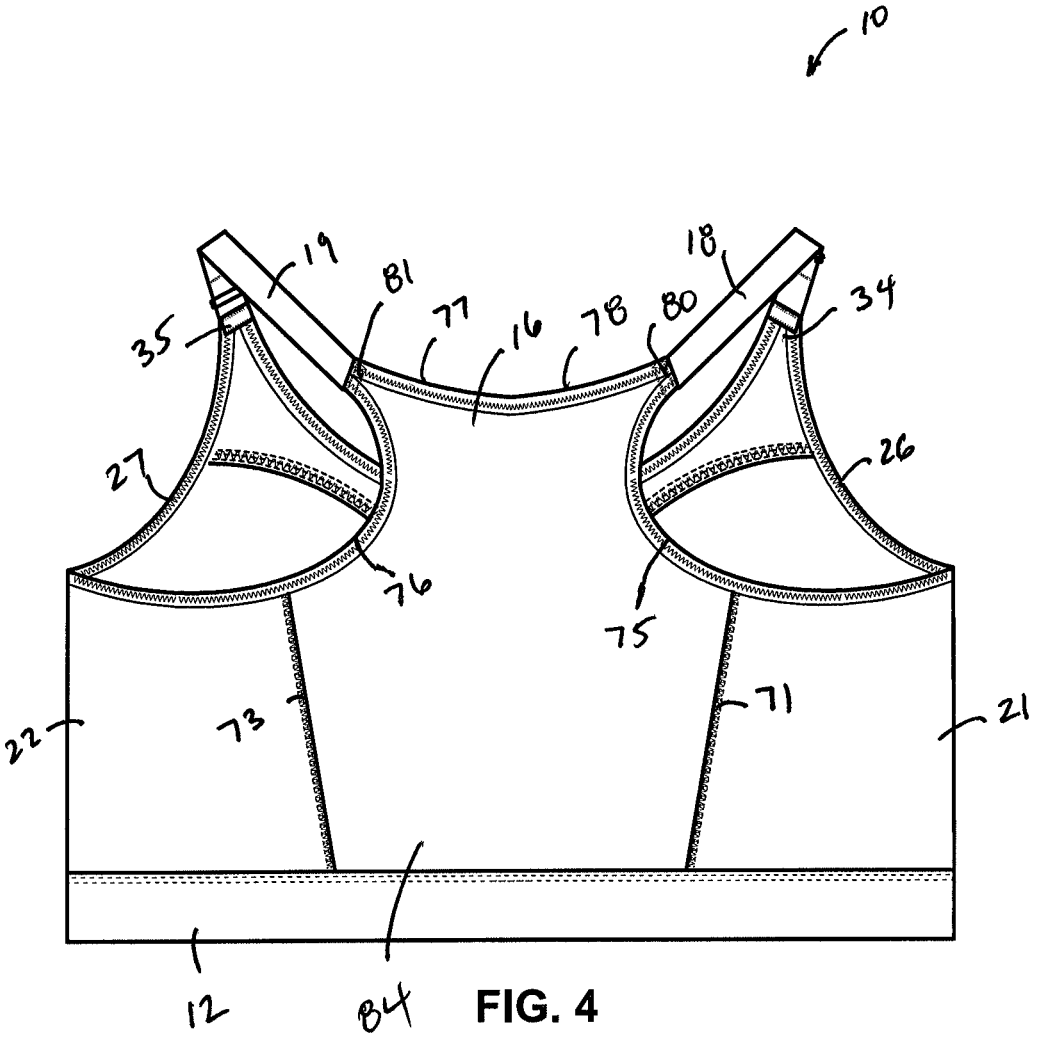
FIG. 4 is a rear elevational view of the athletic bra of FIG. 1.
Figure 5:
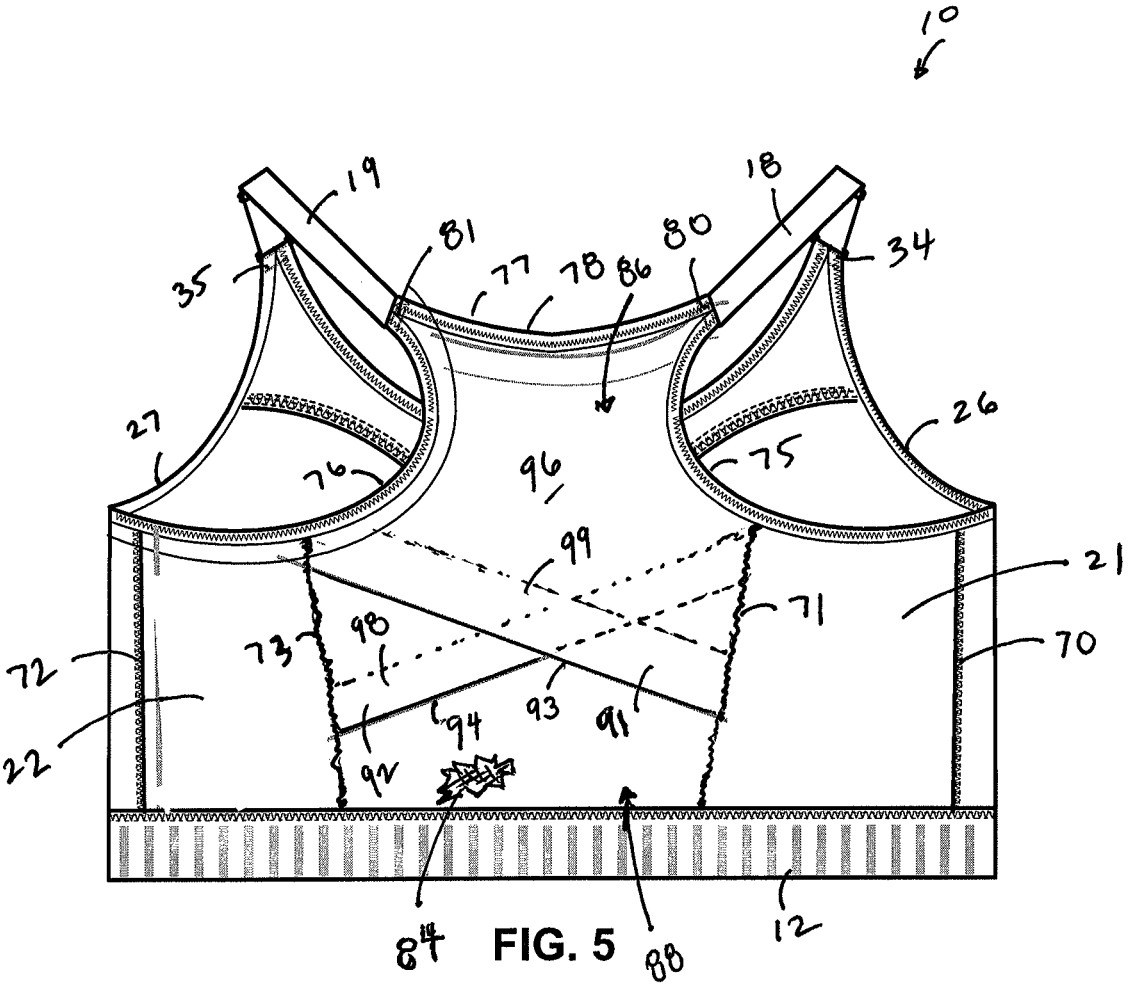
FIG. 5 is a rear elevational view of the athletic bra of FIG. 1 and showing the outer layer removed to reveal an inner layer bonded to the outer layer.

In reference now to FIGS. 4 and 5, the back section 16 is shown in further detail. The back section 16 is secured to the band 12. The back section 16 has free edges 75, 76, opposite of the lower edge joined to the band 12. The free edges 75, 76 form a portion of the arm holes 26, 27. A free edge 77, extending between free edges 75, 76, form a rear part 78 of the neckline 24.

A first attachment section 80 is located between free edge 77 and free edge 75. The shoulder strap 18 is secured to the first attachment section 80, such that the strap 18 extends between 80 and the first attachment section 34 of the breast covering section 14.

A second attachment section 81 is between the free edge 76 and free edge 77, and the shoulder strap 19 is secured to the second attachment section 81. The shoulder strap 19 extends between the second attachment section 81 on the back section 16 to the second attachment section 35 on the breast covering section 14.

As can be seen in FIGS. 4 and 5, the back second 16 is in the shape of a "racerback" or t-back. Many variations in the appearance and construction of the back section 16 are possible.

The back section 16 is constructed with an outer layer 84. The outer layer 84 extends between the band 12 and the free edges 75, 76, 77. FIG. 5 illustrates the back section 16 with the outer layer 84 broken away. In FIG. 5, with the outer layer 84 removed, there is revealed an inner layer 86. The inner layer 86 is spaced from the band 12 such that a lower section 88 of the back section 16 comprises only the outer layer 84. In FIG. 5, with the outer layer 84 removed, there is an open space between the band 12 and where the inner layer 86 starts.

The inner layer 86, in this embodiment, includes a first inner layer section 91 and a second inner layer section 92. The second inner layer section 92 is the layer that is against the skin. The second inner layer section 92 has a free edge 94 that extends from stich line 73 diagonally upwardly from adjacent, but spaced from, the band 12 in a direction toward the first arm hole 26 to the stitch line 71. The first inner layer section 91 is layered on top of the second inner layer section 92 and has a free edge 93 that extends diagonally from the stitch line 71 adjacent, but spaced from, the band 12 upwardly toward the second arm hole 27 and free edge 76 to the stich line 73.

An upper portion 96 of the back section 16 is three layers, including the outer layer 84, the first inner layer 91, and the second inner layer 92. The first and second inner layers 91, 92 are adhesively bonded to the outer layer 84 along two intersecting strips 98, 99, which extend diagonally across the back section 16. Many embodiments for the back section 16 are possible, and this is just one example.

The outer layer 84, first inner layer section 91 and second inner layer section 92 can be made from many types of materials. In example embodiments, these layers can be made from the same materials that make the rest of the bra materials. For example, this can be a flexible fabric of at least 80% nylon and no greater than 20% spandex. For example, the material can be 87% nylon (yarn size of 70-35 dull nylon) and 13% spandex (yarn being 40 denier) with a weight of 7 ounces per square yard.

All of the fabrics used in the bra 10 preferably have wicking and antimicrobial treatments. Preferably, the adhesives used for bonding is polyurethane. The neckline 24 and arm holes 26, 27 preferably have elastic binding.

The straps 18, 19 can be made to be adjustable having plastic sliders at 101, 102.

All seams used in the bra 10 can be made from a thread that is a polyspandex.

A method of making the bra 10 can be implemented. The method can include providing the band 12 to surround a torso of a user. Next, breast covering section 14 can be provided. Breast covering section 14 has inner layer 40 that forms cups 42, 43. Each cup 42, 43 is constructed and arranged to encapsulate a respective one of the breasts.

There can be a step of spraying an adhesive on support member 46 and bonding the support member 46 to the inner layer 40. The support member 46 includes lower section 48 extending between each of the cups 42, 43, and the band 12 and a medial section 50 extending at least partially between the cups 42, 43.

The method can include securing the breast covering section 14 to the band 12. Next, there can be a step of securing back section 16 to the band 12. The method can also include joining the breast covering section 14 and the back section 16 with shoulder straps 18, 19.

There can be a step of making the cups 42, 43 by molding the fabric of the inner liner 40 against heated molds shaped as breast cups. The molds are graded for each bra band being sized 32-50 inches.

In the step of providing the support member 46, the support member 46 can be provided as a continuous strip of material 60 that includes first lateral section 56 and second lateral section 57. The first lateral section 56 extends from the lower section 48 at least partially along a side of cup 42, so that cup 42 is positioned between the first lateral section 56 and the medial section 50. The second lateral section 57 extends from the lower section 48 at least partially along a side of the second cup 43, so that the second cup 43 is positioned between the second lateral section 57 and the medial section 50.

The step of providing the support member 46 can include providing the support member 46 so that the medial section 50 is shaped as a convex curve.

The step of adhesively bonding the support member 46 to the inner layer 40 can include using a polyurethane adhesive that has been warmed to the same ambient temperature as the temperature of the fabric of the inner layer 40. After bonding, the layers are allowed to cure at room temperature for at least 24 hours.

The above represents example constructions, implementations, and materials. Many embodiments can be made using the principles explained above.

What is claimed is:

1. An athletic bra to support a human wearer's breasts; the bra comprising:

(a) a band to surround the wearer's torso;

(b) a breast-covering section secured to the band, the breast-covering section including, (i) an inner layer of fabric including a pair of cups molded into the fabric, each cup constructed and arranged to encapsulate a respective one of the breasts;

(ii) a support member bonded to the inner layer; the support member including, (A) a lower section extending between each of the cups and the band; and (B) a medial section extending at least partially between the cups;

(c) a back section secured to the band, wherein the back section includes:

(i) an outer layer secured to the band; and (ii) an inner layer bonded to the outer layer and spaced from the band; the inner layer bonded to the outer layer along two intersecting bond strips, each strip extending diagonally across the back section; and (d) a pair of shoulder straps joining the breast covering section and the back section, wherein the outer layer extends to the shoulder straps.

2. The bra of claim 1, wherein the breast covering section further includes an outer layer covering the inner layer.

3. The bra of claim 1, wherein the support member further includes a first lateral section and a second lateral section:

(a) the first lateral section extending from the lower section at least partially along a side of a first one of the cups, so that the first one of the cups is positioned between the first lateral section and the medial section; and (b) the second lateral section extending from the lower section at least partially along a side of a second one of the cups, so that the second one of the cups is positioned between the second lateral section and the medial section.

4. The bra of claim 3, wherein the lower section, medial section, first lateral section, and second lateral section are contiguous.

5. The bra of claim 3, wherein the lower section, medial section, first lateral section, and second lateral section are a same continuous piece of material.

6. The bra of claim 3, wherein the medial section extends from the lower section between the cups no more than 75% of a diameter of the cups.

7. The bra of claim 3, wherein the medial section extends from the lower section between the cups no more than 50% of a diameter of the cups.

8. The bra of claim 3, wherein the first lateral section and the second lateral section each extends from the lower section a distance of greater than 50% of a diameter of the cups.

9. The bra of claim 3, wherein the first lateral section and the second lateral section each extends from the lower section a distance of greater than 75% of a diameter of the cups and less than 95% of the diameter of the cups.

10. The bra of claim 3, wherein the medial section is convex-curve shaped.

11. The bra of claim 1, wherein the inner layer comprises a fabric that is at least 80% nylon and no greater than 20% spandex.

12. The bra of claim 1, wherein the inner layer comprises a fabric that is 87% nylon and 13% spandex and having a weight of 7 oz. per square yard.

13. The bra of claim 1, further comprising:

(a) a first side panel secured to the band and extending between a first side of the breast-covering section and the back section; and (b) a second side panel secured to the band and extending between a second side of the breast-covering section and the back section; and whereby arm holes are defined by free edges of the breast-covering section, back section, first side panel, and second side panel.

14. The bra of claim 1, wherein the band has a circumference of even numbers between 32 inches and 50 inches.

15. The bra of claim 14, wherein the cups in the inner layer are constructed and arranged to accommodate breast cup sizes of AAA up to and including K.

16. An inner support construction used with an athletic bra to support a human wearer's breasts; the inner support construction comprising:

(a) a layer of fabric having a pair of cups molded from the fabric, each cup constructed and arranged to encapsulate a respective one of the breasts; the layer having a bottom edge for attachment to a band and an opposite edge; the cups being spaced between the edges; and (b) a support member bonded to the layer; the support member including, (i) a lower section extending between each of the cups and the bottom edge;

(ii) a medial section extending at least partially between the cups;

(iii) a first lateral section extending from the lower section at least partially along a side of a first one of the cups, so that the first one of the cups is positioned between the first lateral section and the medial section; and (iv) a second lateral section extending from the lower section at least partially along a side of a second one of the cups, so that the second one of the cups is positioned between the second lateral section and the medial section.

17. The inner support construction of claim 16, wherein:

(a) the lower section, medial section, first lateral section, and second lateral section are a same continuous piece of material;

(b) The medial section extends from the lower section between the cups not more than 75% of a diameter of the cups;

(c) the first lateral section and the second lateral section each extends from the lower section a distance of greater than 50% of a diameter of the cups;

(d) the medial section is convex-curve shaped; and (e) the layer comprises a fabric that is at least 80% nylon and no greater than 20% spandex.

18. A method of making an athletic bra; the method comprising:

(a) providing a band to surround a wearer's torso;

(b) providing a breast-covering section having an inner layer with a pair of cups, each cup constructed and arranged to encapsulate a respective one of the breasts;

(c) spraying an adhesive on a support member and bonding the support member to the inner layer; the support member having a lower section extending between each of the cups and the band; and a convex-curve shaped medial section extending at least partially between the cups;

(d) securing the breast-covering section to the band;

(e) securing a back section to the band, wherein securing the back section includes (i) securing an outer layer to the band; and (ii) bonding an inner layer to the outer layer, wherein the inner layer is bonded to the outer layer along two intersecting bond strips, each strip extending diagonally across the back section; and (f) and joining the breast covering section and the back section with a pair of shoulder straps, wherein the outer layer extends to the pair of shoulder straps.

19. The method of claim 18, wherein the cups in the inner layer are made by molding the inner layer against heated molds shaped as breast cups.

* * * * *